US007654787B2

(12) United States Patent
Sonerud

(10) Patent No.: US 7,654,787 B2
(45) Date of Patent: Feb. 2, 2010

(54) TOOL HOLDER WITH HYDRAULIC COUPLING MEANS

(75) Inventor: Åke Sonerud, Hudiksvall (SE)

(73) Assignee: Oilquick AB, Hudiksvall (SE)

( * ) Notice: Subject to any disclaimer, the term of this patent is extended or adjusted under 35 U.S.C. 154(b) by 804 days.

(21) Appl. No.: 10/543,690

(22) PCT Filed: Jan. 29, 2004

(86) PCT No.: PCT/SE2004/000117

§ 371 (c)(1),
(2), (4) Date: Jul. 27, 2005

(87) PCT Pub. No.: WO2004/067855

PCT Pub. Date: Aug. 12, 2004

(65) Prior Publication Data

US 2006/0101953 A1 May 18, 2006

(30) Foreign Application Priority Data

Jan. 30, 2003 (SE) ..... 0300229

(51) Int. Cl.
*B66F 9/18* (2006.01)

(52) U.S. Cl. ..... 414/723; 414/569

(58) Field of Classification Search ..... 414/723, 414/569

See application file for complete search history.

(56) References Cited

U.S. PATENT DOCUMENTS 3,243,066 A * 3/1966 Gardner et al. ..... 414/698
3,873,133 A * 3/1975 Berg et al. ..... 285/121.7
4,208,163 A * 6/1980 Holmqvist ..... 414/723
4,280,783 A 7/1981 Hayward
4,431,365 A 2/1984 Sturtz, Jr.
4,955,779 A * 9/1990 Knackstedt ..... 414/723
5,049,027 A 9/1991 Morrison et al.
5,727,342 A * 3/1998 Horton ..... 37/468
6,196,595 B1 * 3/2001 Sonerud ..... 285/26

FOREIGN PATENT DOCUMENTS

EP 0 447 119 A1 9/1991
EP 0 943 738 A1 9/1999
FR 2 304 726 A1 10/1976

* cited by examiner

*Primary Examiner*—Saúl J Rodríguez
*Assistant Examiner*—Jonathan D Snelting
(74) *Attorney, Agent, or Firm*—The Maxham Firm

(57) ABSTRACT

The invention relates to a tool holder for cranes. The tool holder comprises hydraulic cylinder means arranged to detachably be able to lock a tool to the tool holder. Furthermore, hydraulic coupling means is comprised and arranged to be connected with hydraulic coupling means on the tool and hydraulic line means. The object of the invention is, among other things, to reduce the number of requisite lines in the hydraulic line means. According to the invention, the tool holder comprises furthermore valve means provided with switching means arranged to connect the hydraulic line means either to the hydraulic cylinder means or to the hydraulic coupling means of the tool holder. Thereby, the same hydraulic line means may be used for the locking i 5 function and the tool. The invention also relates to a crane provided with such a tool holder as well as use of the tool holder.

6 Claims, 4 Drawing Sheets

TOOL HOLDER WITH HYDRAULIC COUPLING MEANS

FIELD OF THE INVENTION

The present invention relates, in a first aspect, to a tool holder for tools for cranes, which tool holder comprises hydraulic cylinder means arranged to detachably be able to lock a tool to the tool holder, hydraulic coupling means arranged to be connected with hydraulic coupling member on tools and hydraulic line means.

In a second aspect, the invention relates to a crane provided with the invented tool holder and in a third aspect to use of the invented tool holder.

BACKGROUND OF THE INVENTION

Tool holders of the corresponding type are used also at different types of contractor's machinery such as excavators, wheel loaders, movers of material and the like machine types. A complication at tool holders for cranes such as, e.g., lorry cranes is that the tools are pendulum suspended, the tool holder being provided with a hydraulic rotator. Such a one is required at timber grip, clamshell bucket, pallet forks and other similar tools.

At conventional tool holders for cranes, hydraulic lines are run to the tool holder for the hydraulic maneuver of the tool as well as for maneuver of the locking mechanism of the tool holder. Since the locking mechanism consists of one or more double-acting hydraulic cylinders, two hydraulic lines are normally run for the locking function. With two or more hydraulic lines for maneuver of the tool, it means that at least four hydraulic lines are run to the tool holder. This implies a relatively complicated, and thereby expensive arrangement. On one hand because the hydraulic lines have to be run up along the entire crane jib, which becomes additionally cumbersome in connection with lorry cranes having a plurality of crane jib projections. And on the other hand because the rotators that most cranes are equipped with, normally only has one pair of swivel fairleads. For maneuver of the locking mechanism, additionally two swivel fairleads are required. It means that the rotator has to be provided with four coil ducts in the swivel, which implies a complication and price increase.

Tool holders of the above-mentioned type are manufactured by OilQuick AB at a system called OQ 60 and by Liebherr at a system called Topas.

Furthermore, a tool holder is previously known manufactured by HEVO Parts AB, at which the hydraulic hose problems are handled in a different way. In that connection, a hydraulic cylinder is integrated in the tool holder, which also serves as tool cylinder. By utilizing the existing work hydraulics under the rotator in this way, no connection of hoses at operation with, e.g., clamshell bucket and pallet forks is needed. At all other types of hydraulic tools, such as earth drill, vibrating tamper, etc., the hydraulic hoses, however, have to be connected as usual by hand. To interconnect hydraulic hoses by hand frequently involves problems, because of back-pressure in the lines as well as general oil mess. A disadvantage of said holder is that only specially adapted tools can be used in connection with the holder. Also size and weight of the holder are experienced as a disadvantage. The holder has mechanical locking, which is made by the operator by hand on site. By this holder, the hydraulic hose problems are partly solved.

The object of the present invention is to provide a tool holder of the kind in question, at which the disadvantages that are associated with previously known tool holders of the corresponding type are eliminated.

SUMMARY OF THE INVENTION

The object set up has, according to the present invention, been attained by the fact that a tool holder of the kind defined in the preamble of claim 1 has the special features that the tool holder comprises valve means provided with switching means arranged to connect the hydraulic line means to either the hydraulic cylinder means or to the hydraulic coupling means of the tool holder.

Thanks to the switchable valve means, the hydraulic lines to the tool holder may serve the double purpose of manoeuvring the locking mechanism as well as manoeuvring the tool. Thereby, the number of requisite hydraulic lines of the hydraulic line means is reduced, the number of lines may, for instance, be reduced from four to two. This decreases the extent of running hydraulic lines along the crane jib as well as the number of swivel fairleads, so that the construction becomes simpler, and thereby more inexpensive.

With a tool holder according to the invention, it is enabled to provide an optimal tool holder system for cranes, especially lorry cranes that comply with those requirements being appropriate to put on such a one, viz.:

- which couples mechanical and hydraulic tools hydraulically
- which automatically connects the tool hydraulics
- which does not require any additional installation need of locking hydraulics on neither crane jib nor crane tip
- which utilizes the tool hydraulic function also for manoeuvring of the locking mechanism of the holder. Mechanical or remote-controlled switching between these functions is okay
- which is easy to maneuver and safe
- which weighs minimally and requires minimal space (height and width)
- which is easy to park during transportation
- which makes it possible to use most mechanical and hydraulic tools on the market
- where the tool holder is mounted under a standard rotator According to a preferred embodiment of the invented tool holder, the cylinder means comprises two double-acting hydraulic cylinders. It may be enough, per se, with only one such hydraulic cylinder. However, the locking becomes less stable or supplementation of the locking by providing the hydraulic cylinder with a mechanical branching is required in order to obtain two-point locking. However, with two hydraulic cylinders the locking becomes simpler. Having more than two hydraulic cylinders is unnecessary and risks leading to an overdetermination of the locking position. By the fact that the hydraulic cylinders are double-acting, the locking and release function, respectively, is achieved in a smooth way.

According to an additional preferred embodiment, the hydraulic coupling means comprises at least two coupling units and the hydraulic line means at least two hydraulic lines. This is an expedient embodiment since the maneuver of the tool in most cases requires more than one hydraulic line.

According to an additional preferred embodiment, each hydraulic coupling unit is connected to the valve means by a hydraulic coupling line and each hydraulic cylinder is connected to the valve means by at least one hydraulic cylinder line, a connection line being arranged between each hydraulic coupling line and one of the hydraulic cylinder lines where a non-return valve is arranged in each connection line, which non-return valve is directed in such a way that it enables flow from the hydraulic coupling line to the hydraulic cylinder line but not in the opposite direction. By the by-pass function that is achieved by this embodiment, it is guaranteed that the pressure in the hydraulic cylinders in locking position is maintained when the hydraulic lines after the locking operation have been switched to connection to the hydraulic coupling member of the tool. Thereby, it is guaranteed in a simple way that the tool is locked to the tool holder during operation.

According to an additional preferred embodiment, the switching member is arranged for manual switching of the connection of the valve means. This represents a simple and safe switching that eliminates the need for running electric cables along the crane jib for maneuver of the valve means.

According to an additional preferred embodiment, the switching means is provided with remote-controlled driving means for switching the connection of the valve means. This embodiment may constitute a complement or alternative to the closest above-described embodiment and eliminates the need for the operator to leave the operator seat thereof at switching the valve means.

Above-mentioned preferred embodiments of the invented tool holder are defined in the claims depending on claim 1.

The crane and the use according to the present invention have advantages of the corresponding type as has been given above for the invented tool holder and the preferred embodiments of the same.

The invention is explained closer by the subsequent detailed description of advantageous embodiment examples of the same while referring to the appended drawings.

DESCRIPTION OF PREFERRED EMBODIMENT EXAMPLES

Figure 1:
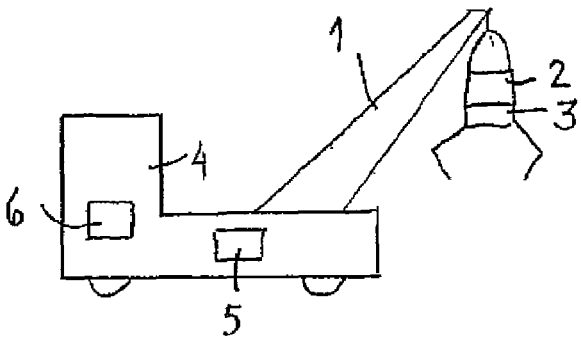
FIG. 1 is a side view of a crane provided with a tool holder according to the invention.

FIG. 1 illustrates application of the invention at a lorry crane. From the crane jib 1, the tool holder 2 is swingingly suspended and a tool 3 is locked to the tool holder. Hydraulic lines, not shown, extend from a hydraulic source of power 5 on the lorry 4 along the crane jib 1 and further down to the tool holder 2. The hydraulic source of power is controlled from a manoeuvring unit 6 handled by an operator.

The tool 3 may be released from the tool holder and be replaced by another kind of tool. The invention is intended to enable such a tool change in an optimal way.

Figure 2:
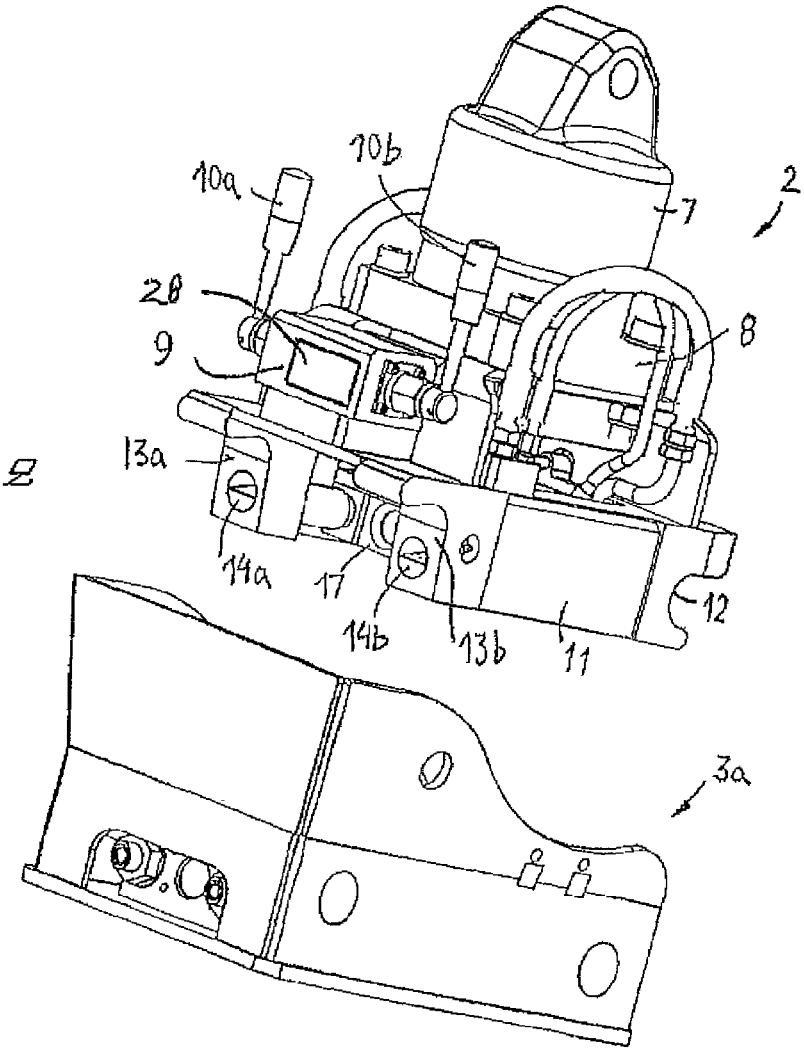
FIG. 2 is perspective view from the side of a tool holder according to the invention in a non-locking position.
Figure 3:
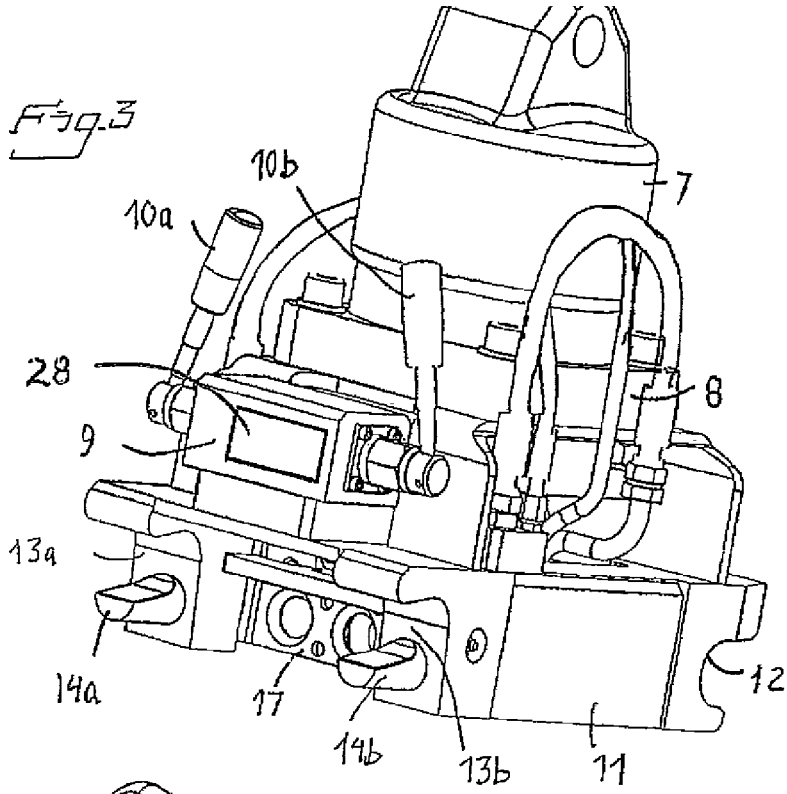
FIG. 3 is a perspective view as in FIG. 2, but illustrating a locking position.
Figure 4:
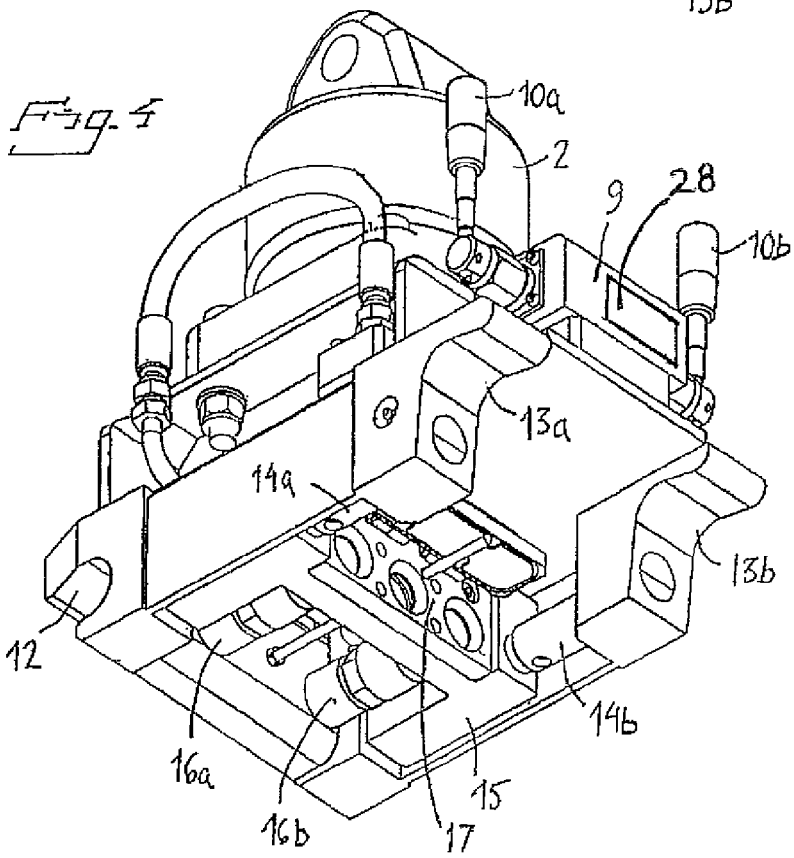
FIG. 4 is a perspective view obliquely from below of the tool holder according to FIG. 2 in a non-locking position.

The tool holder is illustrated more in detail in FIGS. 2-4. In FIG. 2, the tool holder is shown in neutral position. The tool holder 2 is at the top part thereof provided with a rotator 7, which may be rotated in relation to the main part 8 of the tool holder. The lower part of the tool holder constitutes the connection part 11 thereof and is formed to allow connection to a tool gate 3*a* of a tool, i.e., the part of the tool 3 which is adapted to be connected to the tool holder 2. The connection part 11 of the tool holder 2 has on one side thereof two U-shaped recesses 12, only one of which is visible in the figure. On the opposite side of the connection part 11, there are two L-shaped profiles 13*a*, 13*b* and two lock plungers 14*a*, 14*b*, which in FIG. 2 are in a pushed-in position. The same may be pushed out in order to form a U-shaped profile together with the L-profiles.

On the tool gate 3*a*, there are two bars (not shown), which are located in order to co-operate with the recesses 12 and the L-profiles 13*a*, 13*b*, respectively. When a tool is to be connected to the tool holder, the same are positioned so that the U-shaped recesses engage one bar of the tool gate 3*a*. Next, the tool and the tool holder are turned in relation to each other around said bar until the second bar of the tool gate is situated in the L-profiles. In this position, hydraulic cylinders are activated, which project the lock plungers 14*a*, 14*b* so that the second bar becomes located in the U-profile then formed. In the same position, the tool is locked to the tool holder. Furthermore, the hydraulic coupling unit on the tool holder has been brought to connection with hydraulic coupling units on the tool. The sequence of operations described hitherto for the connection is the state of the art.

At the tool holder according to the invention, a valve plate 9 is mounted on the tool holder. The valve plate 9 can be manoeuvered by means of two levers 10*a*, 10*b*. By means of these, the hydraulic lines which lead from the hydraulic source of power to the tool holder can be switched to connect either to the hydraulic cylinders that manoeuvre the locking or to the hydraulic coupling units that are connected with corresponding units on the tool. In the position shown in FIG. 2, the hydraulic cylinders for the lock plungers are not activated. These are activated by turning each lever approx. 15° in towards each other.

Said position is illustrated in FIG. 3. Accordingly, here the lock plungers 14*a*, 14*b* are projected.

In FIG. 4, the tool holder is shown obliquely from below in neutral position, the lock plungers 14*a*, 14*b* being pushed in. Each lock plunger is attached to a H-shaped yoke 15. The yoke 15 is maneuvered by two hydraulic cylinders 16*a*, 16*b*. At activation of these, the yoke 15 is displaced obliquely upwards towards the right in the figure, the lock plungers being displaced outwards to the locking position, shown in FIG. 3. Furthermore, on the yoke 15 a coupling ramp 17 is mounted. The coupling ramp is provided with female coupling units connected to the hydraulic source of power via hydraulic lines (not shown). The female coupling units are arranged to be connected with male coupling units on the tool gate 3*a*. When locking of the tool is carried out by the fact that the lock plungers via the yoke 15 are displaced towards locking position, the coupling ramp 17 is simultaneously displaced up to a position when the coupling units thereof are connected with the corresponding coupling units on the tool units on the tool gate 3*a*.

Figure 5:
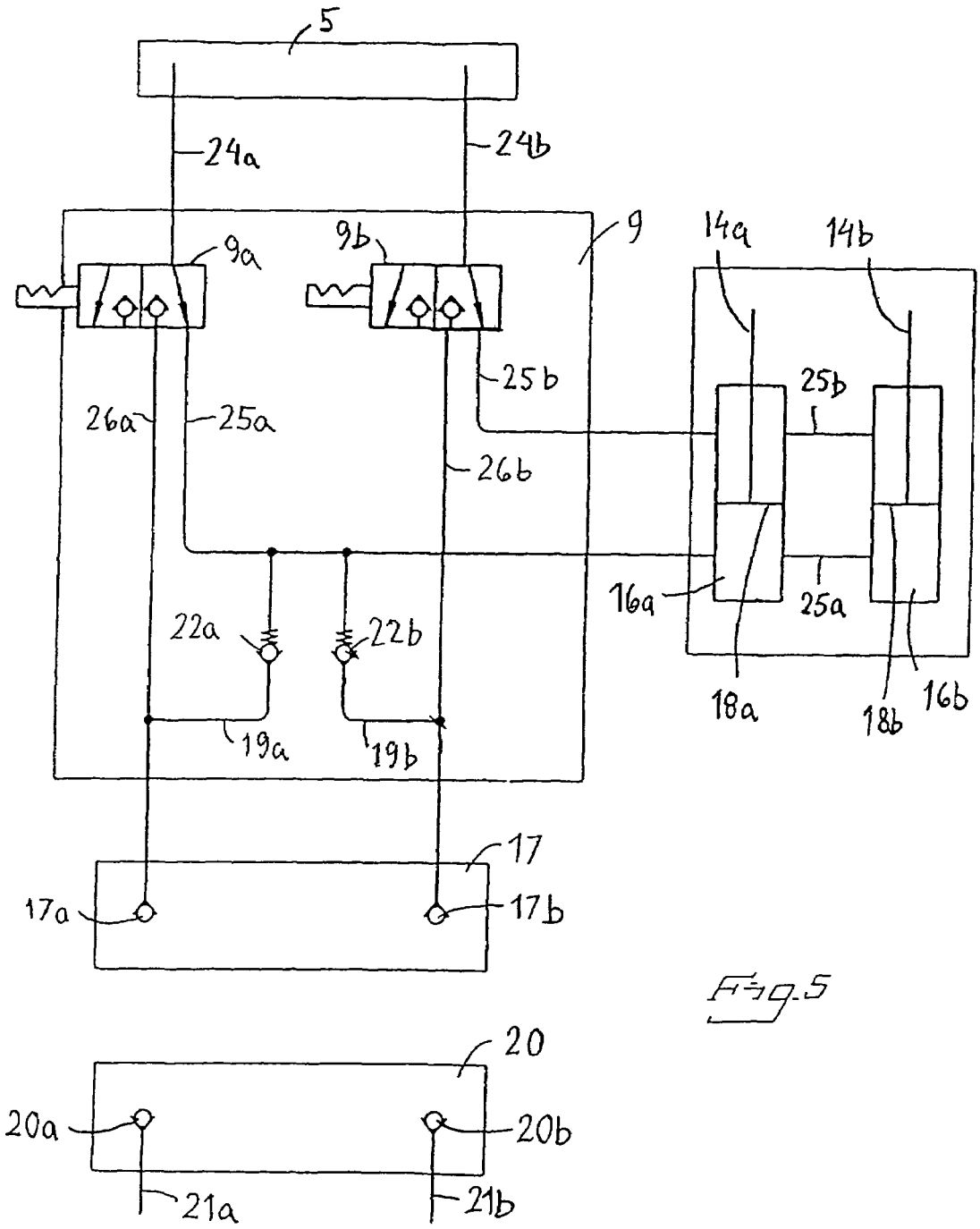
FIG. 5 is a hydraulic scheme for the tool holder in FIGS. 2-4.
Figure 6:
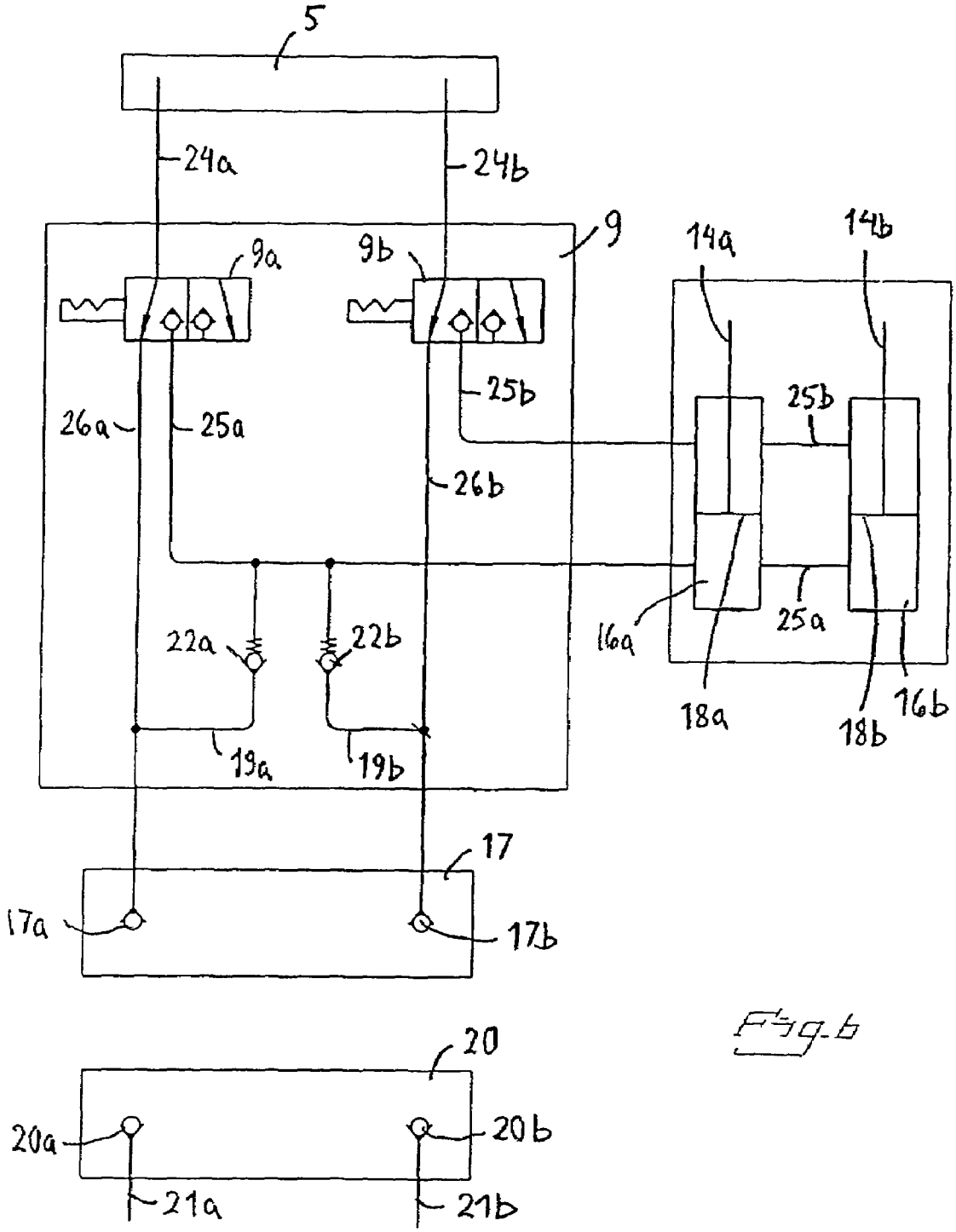
FIG. 6 is a corresponding hydraulic scheme illustrating another valve position.

The principle of the invention should most clearly be seen in the hydraulic schemes in FIGS. 5 and 6.

FIG. 5 illustrates the position when the hydraulics is connected in order to lock the tool. In the valve plate 9, two switching valves 9*a*, 9*b* are arranged. The input side of each valve is connected to a respective hydraulic line 24*a*, 24*b* from the hydraulic source of power 5. Each valve 9*a*, 9*b* may be switched to two different positions, for connection of the output side either to the hydraulic coupling units 17*a*, 17*b* or via hydraulic cylinder lines 25*a*, 25*b* to the hydraulic cylinders 16*a*, 16*b*. In the shown position, the hydraulic lines 24*a*, 24*b* are connected to the hydraulic cylinders 16*a*, 16*b*. When the tool holder 2 and the tool have been positioned into the correct position as has previously been described, the hydraulic line 24*a* is pressurized so that, via the valve 9*a* and the hydraulic cylinder line 25*a*, the plungers 18*a*, 18*b* are displaced upwards in the figure and in that connection projecting the lock plungers 14*a*, 14*b* to locking position, as well as bringing the coupling units 17*a*, 17*b* on the coupling ramp 17 to connection with the coupling units 20*a*, 20*b* on a coupling ramp arranged on the tool gate 3*a*, as has been described in connection with FIG. 4.

When the locking phase is accomplished, the valves 9*a*, 9*b* are switched to the position shown in FIG. 6. The lock plungers are now in locking position and the coupling units 17*a*, 17*b*, 20, 20*b* of the coupling ramps 17, 20 connected. In that connection, the hydraulic lines 24*a*, 24*b* are connected to the hydraulics 21*a*, 21 *b* of the tool via the valves 9*a*, 9*b*, the hydraulic coupling lines 26*a*, 26*b* and the coupling units 17*a*, 17*b*, 20*a*, 20*b*. Thereby, the tool is in an operative state. Between each hydraulic coupling line 26*a*, 26*b*, a connection line 19*a*, 19*b* is arranged to the hydraulic cylinder line 25*a* that is pressurized at locking. In each connection line 19*a*, 19*b*, a non-return valve 22*a*, 22*b* is arranged. These are directed in such a way that flow is allowed from the respective hydraulic coupling line to said hydraulic cylinder line but not in the opposite direction. Thereby, it is is guaranteed that the pressure is maintained on pressure side of each hydraulic cylinder 16*a*, 16*b* during operation thanks to the fact that pressurized hydraulic oil from either of hydraulic coupling line 26*a*, 26*b* may be pressed into the hydraulic cylinder line 25*a* in the event that the pressure in the hydraulic cylinder tends to ebb. Hence, this by-pass function constitutes a locking protection.

When the tool is to be released from tool holder, for instance for exchange of tool, the valves are switched to the position shown in FIG. 5 and the lock plungers are withdrawn by the fact that the second side of each hydraulic cylinder 16*a*, 16*b* (the upper one in the figure) is pressurized. Simultaneously, the coupling ramps 17, 20 are disconnected from each other.

The switching of the valves 9*a*, 9*b* is carried out by the levers 10*a*, 10*b* illustrated in FIGS. 2-4. A locking mechanism (not shown) is arranged for locking the levers when the valves 9*a*, 9*b* are in position for operation, i.e., as in FIG. 6 and with a lever position that is shown in FIG. 3.

As alternative to manual switching by means of the levers 10*a*, 10*b*, a battery-driven motor 28 may be arranged in connection with the valve plate in order to displace positions of the valves. This is suitably operated by wireless remote control.

The invention claimed is:

1. A tool holder for tools for cranes, the tool holder comprising:

two double-acting hydraulic cylinders arranged in parallel and functioning together, said cylinders being configured to detachably lock a tool to the tool holder;

at least two first hydraulic coupling units on the tool;

at least two second hydraulic coupling units configured to be connected with said first hydraulic coupling units;

at least two hydraulic lines;

valve means provided with switching means, said valve means being configured to selectively connect said hydraulic lines to said hydraulic cylinders or to said first hydraulic coupling units;

each said coupling unit being connected to said valve means by a hydraulic coupling line;

each said hydraulic cylinder being connected to said valve means by at least one hydraulic cylinder line;

a connection line coupled between each said hydraulic coupling line and one of said hydraulic cylinder lines; and a non-return valve in each said connection line, said non-return valve being directed to only permit flow from a respective said hydraulic coupling line to said hydraulic cylinder line.

2. The tool holder according to claim 1, wherein said switching means is configured for manual switching of the connections of said valve means.

3. The tool holder according to claim 1, wherein said switching means is provided with remote-controlled driving means for switching the connection of said valve means.

4. A crane having a tool holder, the tool holder comprising:

two double-acting hydraulic cylinders arranged in parallel and functioning together, said cylinders being configured to detachably lock a tool to the tool holder;

at least two first hydraulic coupling units on the tool;

at least two second hydraulic coupling units configured to be connected with said first hydraulic coupling units;

at least two hydraulic lines;

valve means provided with switching means, said valve means being configured to selectively connect said hydraulic lines to said hydraulic cylinders or said first hydraulic coupling units;

each said coupling unit being connected to said valve means by a hydraulic coupling line;

each said hydraulic cylinder being connected to said valve means by at least one hydraulic cylinder line;

a connection line coupled between each said hydraulic coupling line and one of said hydraulic cylinder lines; and a non-return valve in said each connection line, said non-return valve being directed to only permit flow from a respective hydraulic coupling line to said hydraulic cylinder line.

5. The tool holder according to claim 4, wherein said switching means is configured for manual switching of the connections of said valve means.

6. The tool holder according to claim 4, wherein said switching means is provided with remote-controlled driving means for switching the connection of said valve means.

* * * * *

UNITED STATES PATENT AND TRADEMARK OFFICE

CERTIFICATE OF CORRECTION

PATENT NO. : 7,654,787 B2
APPLICATION NO. : 10/543690
DATED : February 2, 2010
INVENTOR(S) : Åke Sonerud It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1167 days.

Signed and Sealed this

Twenty-third Day of November, 2010

David J. Kappos

David J. Kappos
*Director of the United States Patent and Trademark Office*